US005943885A

United States Patent [19]

Park

[11] Patent Number: 5,943,885

[45] Date of Patent: Aug. 31, 1999

[54] SPIN TUB FOR A WASHING MACHINE

[75] Inventor: Kwan-Choul Park, Kwangju, Rep. of Korea

[73] Assignee: Daewoo Electronics Co., Ltd., Seoul, Rep. of Korea

[21] Appl. No.: 09/000,969

[22] Filed: Dec. 30, 1997

[30] Foreign Application Priority Data

Dec. 30, 1996 [KR] Rep. of Korea ..... 96-62879

[51] Int. Cl.[6] ..... D06F 17/00

[52] U.S. Cl. ..... 68/53; 68/134

[58] Field of Search ..... 68/133, 134, 53; 8/159; 366/219, 224, 227, 229

[56] References Cited

U.S. PATENT DOCUMENTS

| | | | |
|---|---|---|---|
| 3,958,433 | 5/1976 | Bochan | 68/133 |
| 4,137,735 | 2/1979 | Bright et al. . | |
| 5,701,767 | 12/1997 | Cho | 68/134 |
| 5,746,071 | 5/1998 | Youn | 68/133 |
| 5,775,137 | 7/1998 | Yanagisawa | 68/133 |

FOREIGN PATENT DOCUMENTS

| | | | |
|---|---|---|---|
| 519124 | 12/1955 | Canada | 68/133 |
| 1122670 | 5/1956 | France | 68/134 |
| 905129 | 1/1954 | Germany | 68/134 |
| 906926 | 2/1954 | Germany | 68/134 |
| 61-27076 | 5/1986 | Japan | 68/53 |
| 62-82998 | 4/1987 | Japan | 68/134 |
| 64-52499 | 2/1989 | Japan | 68/134 |
| 2-31796 | 2/1990 | Japan | 68/134 |
| 2145435 | 3/1985 | United Kingdom | 68/134 |
| 2308604 | 7/1997 | United Kingdom . | |

*Primary Examiner*—Frankie L. Stinson
*Attorney, Agent, or Firm*—Jacobson, Price, Holman & Stern, PLLC

[57] ABSTRACT

A spin tub, which is installed in a washing machine, includes a washing ring and a ring guide for guiding the washing ring to be rotated along an inner sidewall of the spin tub, an engaging means for fixing the ring guide on an inner sidewall of the spin tub, and an assembling means for assembling the washing ring and the pulsator in order to provide a rotation force of the pulsator to the washing ring. The ring guide is inclined with respect to the spin axis of the spin tub, whereby when the washing ring is rotated by the pulsator, the water ring impacts on the laundry upwardly elevated along the inner side wall of the spin tub.

9 Claims, 3 Drawing Sheets

SPIN TUB FOR A WASHING MACHINE

BACKGROUND OF THE INVENTION

1. Field of the Invention

This invention relates to a washing machine, more particularly to a spin tub for a washing machine which is installed in a water container in order to dehydrate the laundry.

2. Description of the Prior Art

FIG. 1 is a sectional view for showing the construction of a conventional washing machine with a spin tub installed.

Referring to FIG. 1, a washing machine 100 includes a main body 110, a tub 120, a spin tub 130, a pulsator 140, and a driving device 150. The main body 110 resiliently supports the tub 120 therein through a resilient supporting mechanism (not shown). The spin tub 130 made, for example, of plastic is arranged in the tub and has on its peripheral wall a plurality of perforation for dehydration of the laundry. The pulsator 140 is disposed in the lower portion of the spin tub 130 to be rotated in clockwise and counterclockwise directions according to a driving force which is provided by the driving device 150. The driving device 150 includes a driving force-generating motor 1501, a clutch 1502 which can connect or disconnect the driving force of the motor transmitted through a pulley 1503, and a driving shaft 1504 which transmits the driving force of the motor 1501 to the pulsator 140 or the spin tub 130.

Therefore, when the laundry(not shown) has been put into the spin tub 130 of the washing machine 100, and the motor 1501 is operated by a control program or data set by a user, the driving force of the motor 1501 is transmitted to the clutch 1502 by way of the pulley 1503.

The clutch 1502 transmits the driving force of the motor 1501, which is transferred through the pulley 1503 during washing or spin drying and the like, to the pulsator 140 or to the spin tub 130 through the driving shaft 1504.

In other words, during the washing process, the clutch 1502 is operated for transmitting the driving force of the driving device 150, and the washing machine 100 measures an amount of the laundry by operating the pulsator 140 in clockwise and counterclockwise directions.

When the amount of the laundry is measured, washing water is supplied by a tap (not shown) according to the amount of the laundry, and the driving device operates the pulsator to be rotated in the clockwise and counter clockwise directions. A friction force and/or turbulence generated by the operation of the pulsator 140 among the washing water, laundry, pulsator 140 and the spinning tub 130 performs washing the laundry.

The clutch 1502, during a spin cycle, transmits the driving force of the motor 1501 to the spinning tub 130 so as to rotate the spinning tub 130 in a high revolution for performance of spin driving. Of course, before the spin cycle, draining is performed.

The conventional washing machine 100 so operated in the above operating process performs repeatedly once or up to several times the washing water supply, washing, draining, spin cycle, and rinsing procedures in accordance with a control program, the user's setting data or the amount of the laundry.

One example of a spin tub is disclosed in U.S. Pat. No. 4,137,735. The spin tub suggested in U.S. Pat. No. 4,137,735 includes a perforated vertical side wall, an imperforated bottom wall, and a curved wall portion connecting the perforated vertical side wall and the imperforated bottom wall with each other. The curved wall portion has a circumscribing row of holes formed thereon to thereby carry particulate matter from the spin tub during wash periods while minimizing undesirable back flow through the row of holes during spin periods of the tub.

SUMMARY OF THE INVENTION

It is an object of the present invention to provide a spin tub for a washing machine which can improve washing efficiency.

In order to achieve the above object, a spin tub according to the present invention includes a washing ring being rotated in the spin tub; a ring guide for guiding the washing ring to be rotated along an inner sidewall of the spin tub; an engaging means for fixing the ring guide on an inner sidewall of the spin tub; and an assembling means for assembling the washing ring and the pulsator in order to provide a rotation force of the pulsator to the washing ring. Furthermore, the ring guide is inclined with respect to the spin axis of the spin tub, whereby the washing ring has a rotation orbit which is inclined with respect to the spin axis.

According the present invention, when the washing ring is rotated by the pulsator, the water ring impacts on the laundry which is upwardly elevated along the inner side wall of the spin tub, such that washing efficiency of the washing machine is improved.

BRIEF DESCRIPTION OF THE DRAWINGS

The foregoing and other objects, aspects and advantages will be better understood from the following detailed description of preferred embodiments of the invention with reference to the drawings, in which.

DESCRIPTION OF THE PREFERRED EMBODIMENT

Preferred embodiments of the present invention will be illustrated below with reference to the accompanying drawings.

Figure 2:
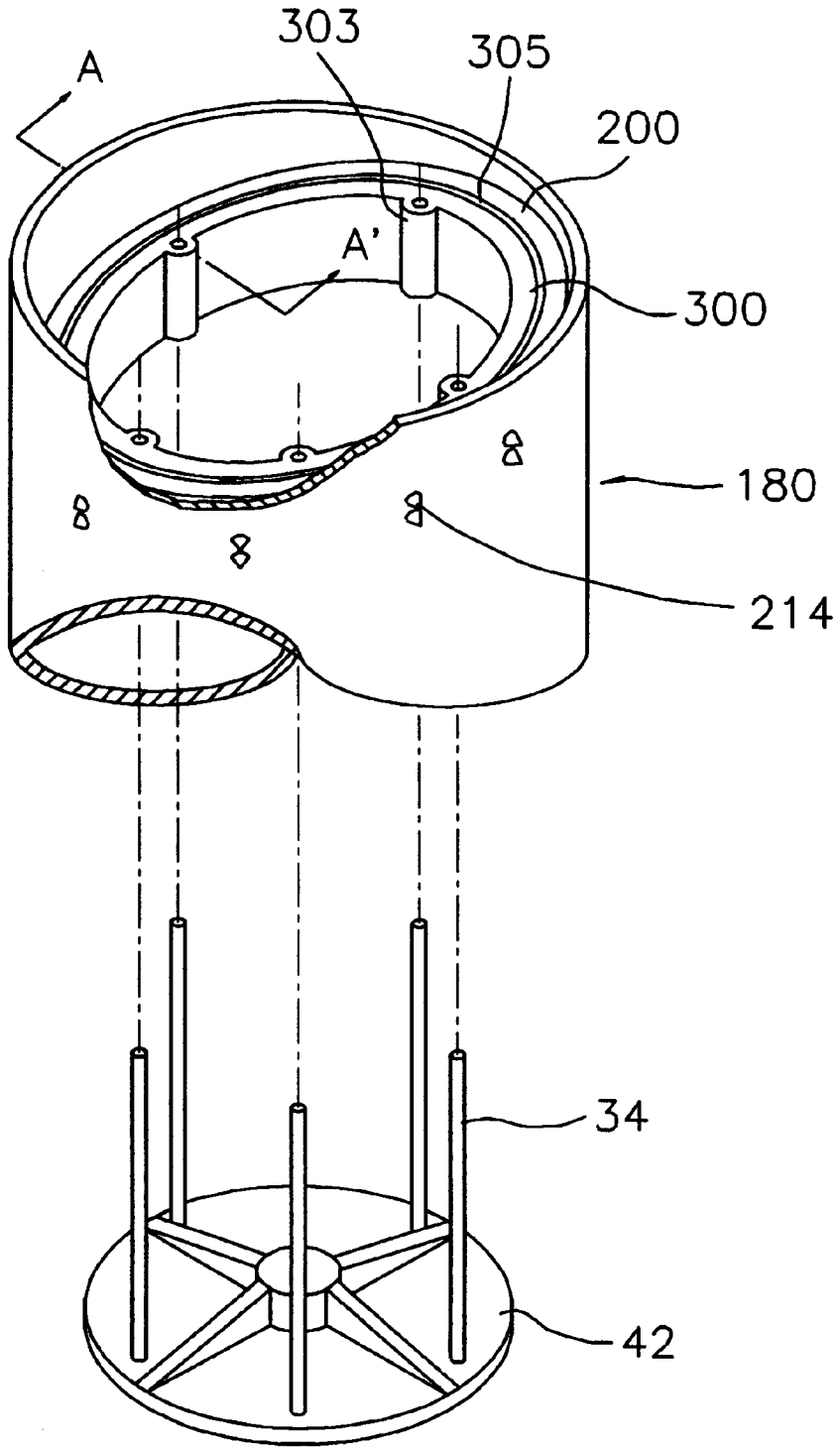
FIG. 2 is an exploded perspective view of a spin tub according to an embodiment of the present invention.

FIG. 2 is an exploded perspective view of a spin tub according to an embodiment of the present invention.

Figure 3:
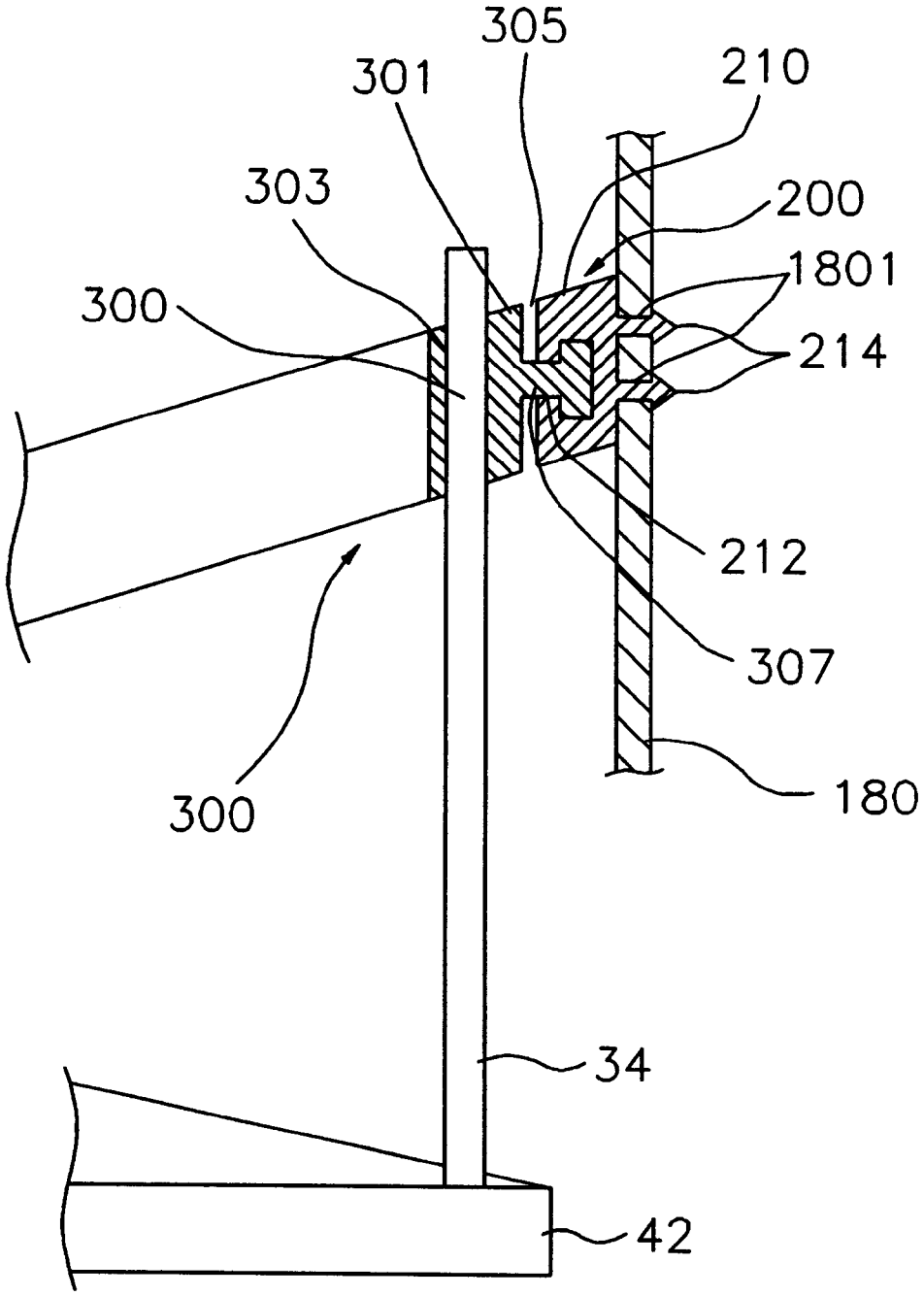
FIG. 3 is an enlarged, fragmentary, cross-sectional view for showing a state of assembling the spin tub and tub taken along lines A-A' of FIG. 2.

FIG. 3 is an enlarged, fragmentary, cross-sectional view for showing a state of assembling a connecting ring and a washing ring taken along lines A-A' of FIG. 2.

With reference to FIG. 2, a spin tub 180 according to the present invention includes a ring guide 200 and a washing ring 300.

The spin tub 180 has a plurality of pin holes 110 formed through a side wall of the spin tub 180.

The ring guide 200 is mounted on an inner side wall of the spin tub 180 in order to guide a rotation of the washing ring 300 in the spin tub 180. Also, the ring guide 200 is inclined with respect to the spin axis of the spin tub 180. Therefore, a circulation orbit of the washing ring 300 is also inclined with respect to the spin axis of the spin tub 180.

The washing ring 300 is made of a flexible material, such as rubber or plastic. The washing ring 300 has a first cylindrical rim 301, a second cylindrical rim 306, and a neck

307 connecting the first cylindrical rim 301 and the second cylindrical rim 306 with each other. A plurality of assembling ridges 303 protrude from an inner surface of the first cylindrical rim 301. Each of the plurality of assembling ridges 303 has a rod hole 304 having a shape of a vertically extending tunnel. The second cylindrical rim 306 surrounds the first cylindrical rim 301 and is spaced apart therefrom with a predetermined gap 305. An outer cylindrical surface of the first cylindrical rim 301 is connected to an inner outer cylindrical surface of the second cylindrical rim 306 through the neck 307 which is formed integrally with the first cylindrical rim 301 and the second cylindrical rim 306.

The ring guide 200 has a third cylindrical rim 210 and an engaging means, such as a plurality of engaging pins 214. The third cylindrical rim 210 has a guide hole 212. The guide hole 212 is formed through the entire length of the third cylindrical rim 210 which has a shape of a belt surrounding the second cylindrical rim 306. Also, as shown in FIG. 3, the guide hole 212 is longitudinally slit through an inner surface of the third cylindrical rim 210 so as to be open toward the second cylindrical rim 306 at the inner surface of the third cylindrical rim 210. The ring guide 200 is firmly fixed on the inner sidewall of the spin tub 180 by the plurality of engaging pins 214. The plurality of engaging pins 214 protrude outward from an outer surface of the third cylindrical rim 210. Each of the engaging pins 214 has a shape of a hook to be tightly engaged with each of the pin holes 1801.

The second cylindrical rim 306 is slidably fitted in the guide hole 212. In this case, the neck 307 is also slidably fitted in the slit portion of the guide hole 212.

The washing ring is rotated by a rotation force which is provide from the pulsator 42. For providing a rotation force of the pulsator 42 to the washing ring 300, a plurality of assembling rods 34 upwardly extending from the pulsator 42 along the spin axis of the spin tub 180 are employed. The plurality of assembling rods 34 are inserted in and slimly assembled with the rod holes 304 one by one.

Figure 1:
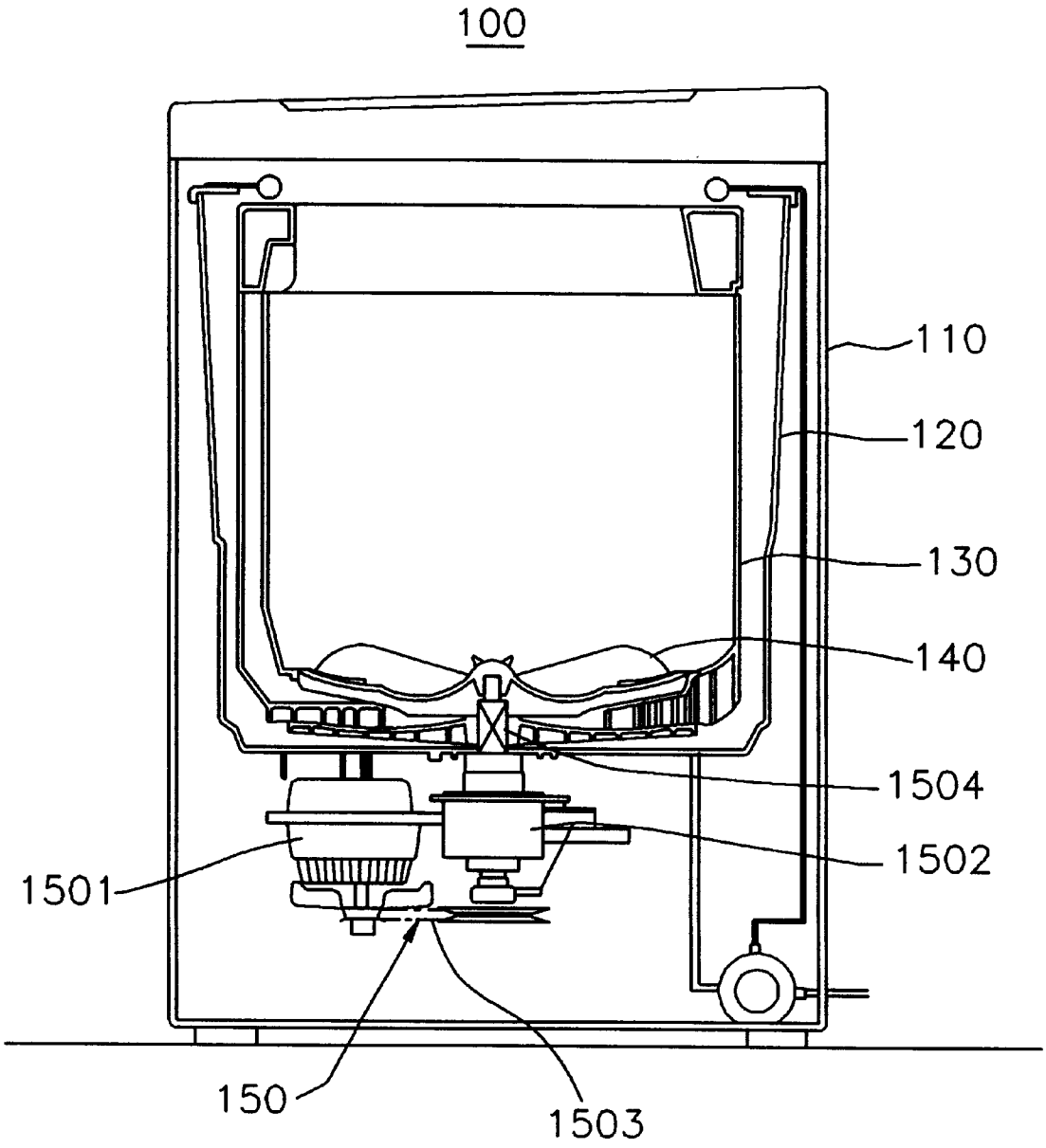
FIG. 1 is a cross-sectional view of a conventional washing machine with a spin tub installed.

As illustrated in FIGS. 1 through 3, while a washing machine is operated, the pulsator 42 and the washing ring 300 are simultaneously agitated in the spin tub 180. As the pulsator 42 is agitated, centrifugal force is provided to washing water. The washing water having the centrifugal force flows radially from the central portion of the pulsator 42 to the inner wall of the tub 120, at the lower portion of the tub 120, and is upwardly elevated along the inner wall of the tub 120. As the washing water flows radially and along the inner wall of the tub 120, the laundry also moves radially and along the inner wall of the spin tub 180 by the flow of washing water.

In this time, the washing ring impacts on the laundry elevated along the inner wall of the spin tub 180 with the rotation force thereof, such that a washing efficiency of the washing machine is improved. Furthermore, the washing ring 300 prevents the laundry from tangling with each other by obstructing a collection of the laundry at the central portion in the spin tub 180.

While the invention has been described in terms of the preferred two embodiments, those skilled in the art will recognize that the invention can be practiced with modification within the spirit and scope of the appended claims.

What is claimed is:

1. A spin tub for a washing machine having a pulsator, the spin tub comprising:

a washing ring being rotated in the spin tub;

a ring guide for guiding the washing ring to be rotated along an inner sidewall of the spin tub;

an engaging means for fixing the ring guide on an inner sidewall of the spin tub; and an assembling means for assembling the washing ring and the pulsator in order to provide a rotation force of the pulsator to the washing ring.

2. A spin tub for a washing machine as claimed in claim 1, wherein said ring guide is inclined with respect to the spin axis of the spin tub, whereby the washing ring has a rotation orbit which is inclined with respect to the spin axis.

3. A spin tub as claimed in claim 1, wherein said assembling means includes a plurality of assembling ridges protruding from an inner surface of the washing ring, wherein each of the plurality of assembling ridges has a rod hole having a shape of a vertically extending tunnel; and a plurality of assembling rods upwardly extending from the pulsator along the spin axis of the spin tub, wherein the plurality of assembling rods are inserted in and slimly assembled with the rod holes one by one.

4. A spin tub for a washing machine as claimed in claim 1, wherein said engaging means includes a plurality of engaging pins which outwardly protrude from an outer surface of the ring guide, wherein each of the plurality of engaging pins is engaged with each of a plurality of pin holes formed through a cylindrical wall of the spin tub.

5. A spin tub for a washing machine as claimed in claim 1, wherein said washing ring includes a first cylindrical rim having a plurality of assembling ridges which protrude from an inner surface thereof;

a second cylindrical rim surrounding outside of the first cylindrical rim 301, the second cylindrical rim spaced apart therefrom with a predetermined gap; and a neck connecting the first cylindrical rim and the second cylindrical rim 306 with each other, wherein each of the plurality of assembling ridges has a rod hole having a shape of a vertically extending tunnel.

6. A spin tub for a washing machine as claimed in claim 5, wherein said ring guide includes a third cylindrical rim having a guide hole which is formed through an entire length of the third cylindrical rim; and a plurality of engaging pins protruding outward from an outer surface of the third cylindrical rim, each of the plurality of engaging pins having a shape of a hook to thereby be engaged with each of the pin holes, wherein, the guide hole is longitudinally slit through an inner surface of the third cylindrical rim so as to be open toward the second cylindrical rim at the inner surface of the third cylindrical rim, such that the second cylindrical rim is slidably fitted in the guide hole and the neck is slidably fitted in the slit portion of the guide hole.

7. A spin tub for a washing machine as claimed in claim 5, wherein said assembling means is a plurality of assembling rods extending upward from the pulsator along the spin axis of the spin tub, the plurality of assembling rods inserted in and slimly assembled with the rod holes one by one.

8. A spin tub for a washing machine having a pulsator, the spin tub comprising:

a washing ring including a first cylindrical rim having a plurality of assembling ridges which protrude from an inner surface thereof, each of the plurality of assembling ridges having a rod hole having a shape of a vertically extending tunnel, a second cylindrical rim which surrounds outside of the first cylindrical rim and is spaced apart therefrom with a predetermined gap, and a neck which connects the first cylindrical rim and the second cylindrical rim 306 with each other;

a ring guide including a third cylindrical rim having a guide hole which is formed through an entire length of the third cylindrical rim, and a plurality of engaging pins protruding outward from an outer surface of the third cylindrical rim, each of the plurality of engaging pins having a shape of a hook to thereby be engaged with each of the pin holes, wherein the guide hole is longitudinally slit through an inner surface of the third cylindrical rim so as to be open toward the second cylindrical rim at the inner surface of the third cylindrical rim, such that the second cylindrical rim is slidably fitted in the guide hole and the neck is slidably fitted in the slit portion of the guide hole; and a plurality of assembling rods extending upward from the pulsator along the spin axis of the spin tub, the plurality of assembling rods inserted in and slimly assembled with the rod holes one by one.

9. A spin tub for a washing machine as claimed in claim 8, wherein said ring guide is inclined with respect to the spin axis of the spin tub, whereby the washing ring has a rotation orbit which is inclined with respect to the spin axis.

* * * * *